US006413142B1

(12) United States Patent
Weastler

(10) Patent No.: US 6,413,142 B1
(45) Date of Patent: Jul. 2, 2002

(54) EXPANDABLE DOLL OR THE LIKE

(76) Inventor: Virginia Weastler, 168-11 12th Ave. apt. 4C, Beechhurst, NY (US) 11357

( * ) Notice: Subject to any disclaimer, the term of this patent is extended or adjusted under 35 U.S.C. 154(b) by 105 days.

(21) Appl. No.: 09/654,243

(22) Filed: Sep. 2, 2000

(51) Int. Cl.[7] ..... A63H 3/06; A63H 13/00
(52) U.S. Cl. ..... 446/320; 446/338; 446/339
(58) Field of Search ..... 446/320, 330, 446/337, 338, 339, 340

(56) References Cited

U.S. PATENT DOCUMENTS 4,160,338 A 7/1979 Lyons et al.
4,236,347 A 12/1980 Fauls
4,246,722 A 1/1981 Sapkus et al.
4,259,807 A 4/1981 Silverstein
4,576,585 A * 3/1986 Balogh et al. ..... 446/198
4,622,021 A 11/1986 Darrigo, Sr.
4,828,528 A 5/1989 Chatkis
5,067,924 A 11/1991 Munter
5,125,865 A 6/1992 Orenstein et al.
5,415,580 A 5/1995 Ferri
5,419,729 A * 5/1995 Gross ..... 446/183

* cited by examiner

*Primary Examiner*—Jacob K. Ackun
(74) *Attorney, Agent, or Firm*—Michael I. Kroll

(57) ABSTRACT

The present invention 10 discloses an expandable doll or the like having a central, manually operated air pump 22 which takes air in through a one-way valve 14 located in the doll's naval and is then distributed proportionally to all the extremities through a semi-rigid, plastic air tube 24 distribution system. The expansion takes place through the action of a system of bellows 26 that connect each of the separate bodily elements at their normal junctures 16, 18 and 20. The doll is covered with a realistic, elastic skin 32 which complies with the stretching action of the bellows 26 at each expanding juncture. Each bellows 26 is custom designed for a particular body element in order to be able to expand to the extent and at a rate appropriate for that particular element at each incremental stage of development from a baby to a toddler.

23 Claims, 10 Drawing Sheets

EXPANDABLE DOLL OR THE LIKE

BACKGROUND OF THE INVENTION

1. Field of the Invention

The present invention relates generally to manipulative models and, more specifically, to expandable dolls or to other small-scale representations of animals. This field includes all dolls and/or manikins that can be manipulated in some way. More specifically, there are quite a few dolls that grow or expand in some way. The methods of expansion are as varied as the number of devices and the results vary as much in quality. The approach, in prior art, to solving the problem of achieving the appearance of growth through expansion has obviously been to limit the goal to achieving merely a gross approximation to the growth process based on the assumption that this was the only realistic goal possible in the light of current technology. This approach has invariably resulted in the achievement of only a gross approximation to growth with substantial compromise to appearance.

The present invention, the Expandable Doll, provides a doll that simulates the growth of a child proportionally and incrementally in all areas of the body from an infant stage to that of a toddler using an integrated pneumatic manual pumping system. This proportionality of growth gives the resulting configuration a more normal appearance. The doll is covered with a realistic elastic skin that complies with the stretching action. Each body element in the Expandable Doll is designed to expand at a rate and to an extent appropriate to presenting a realistic simulation of the development of an infant to a toddler.

2. Description of the Prior Art

There are other expanding doll devices designed for simulating growth. Typical of these is U.S. Pat. No. 4,160,338 issued to Paul Lyons et al. on Jul. 10, 1979.

Another patent was issued to Thomas J. Fauls on Dec. 2, 1980 as U.S. Pat. No. 4,236,347. Yet another U.S. Pat. No. 4,246,722 was issued to Jurgis Sapkus on Jan. 27, 1981 and still yet another was issued on Apr. 7, 1981 to Marcia Silverstein as U.S. Pat. No. 4,259,807.

Another patent was issued to Joseph M. Darrigo, Sr. on Nov. 11, 1986 as U.S. Pat. No. 4,622,021. Yet another U.S. Pat. No. 4,828,528 was issued to Jacob Chatkis on May 9, 1989. Another was issued to Beverly L. Munter on Nov. 26, 1991 as U.S. Pat. No. 5,067,924 and still yet another was issued on Jun. 30, 1992 to Henry Orenstein et al. as U.S. Pat. No. 5,125,865. Still another was issued to Jaime Ferri on May 16, 1995 as U.S. Pat. No. 5,415,580.

U.S. Pat. No. 4,160,338

Inventor: Paul Lyons et al.

Issued: Jul. 10, 1979

A toy doll has a mouth opening adapted to receive a simulated nursing bottle from which water is fed to the interior of the doll, some of such water producing a wetting action. The doll is also adapted to produce a burping sound when its back is patted, and simultaneously to spit up through the mouth opening some of the water previously fed from the bottle. The burping sound is produced by a bellows in the body portion of the doll which is successively compressed upon patting the back of the doll and which progressively feeds air into another bellows located in the head of the doll until the head bellows reaches an expanded position. An actuating member then automatically releases the air from the expanded head bellows, which air flows in a sudden controlled flow through a sound producing device. Some of this released air also causes liquid to be emitted from the mouth opening to produce the spitting-up effect.

U.S. Pat. No. 4,236,347

Inventor: Thomas J. Fauls

Issued: Dec. 2, 1980

A flexible doll having a normal form defined by a molded elastic skin and viscous liquid filler and a separate molded head, and which will repeatedly return to its normal form after stretching and deforming of its body parts, is provided with a closure means and head mounting which is a cylindrical member having a large diameter filling passage, and external circumferential flanges spaced along its length. Two of the flanges provide a recess for lamping the doll skin thereto in sealed relationship. End flanges on the cylindrical member coact with a cylindrical bore and flange on the doll head to support it in a manner to be erect and rotatable with respect to the doll body. A plug is provided for sealingly closing the filler passage. The plug is apertured so that the doll body may be squeezed to remove all air therefrom prior to closing the aperture.

This invention relates to a flexible doll having a normal form defined by a molded elastic skin and viscous liquid filler and a separate molded head, and which will repeatedly return to its normal form after stretching and deforming of its body parts, and having closure means which both facilitates filling of the skin with viscous liquid and effectively engages and supports the head in a manner to be erect and rotatable with respect to the doll body.

U.S. Pat. No. 4,246,722

Inventor: Jurgis Sapkus et al.

Issued: Jan. 27, 1981

A baby doll having an extendable torso, an extendable neck, movable legs, and a mechanism for causing the torso and the neck to extend and the legs to straighten so that the doll appears to grow.

U.S. Pat. No. 4,259,807

Inventor: Marcia Silverstein

Issued: Apr. 7, 1981

A fabric-sewn doll, stuffed with polyester stuffing, and including the head and trunk being made in one piece while the arms and legs are separate pieces adjustably attached thereto, so that the size of the doll may be adjusted to be the same height as a growing child and thus be able to share wearing the clothing of the child who owns it.

U.S. Pat. No. 4,622,021

Inventor: Joseph M. Darrigo

Issued: Nov. 11, 1986

A doll that grows is provided and has a device which has a thread portion in engagement with a thread hole for adjustably securing legs to the bottom of a torso of the main body portion of the doll for movement between a retracted portion and an extended position so as to simulate growth for the doll.

U.S. Pat. No. 4,828,528

Inventor: Jacob Chatkis

Issued: May 9, 1989

A doll is provided which has a stretchable inner liner, an expandable core within the inner liner and a skin layer in intimate contact with the inner liner. The inner liner has one or more growth phase means which can be a series of essentially parallel stitchings optionally joined by bridging loops. The growth phases can be simply activated at redetermined times by externally accessible means or by an internal winding device which can be caused to rotate from an external location of the doll.

U.S. Pat. No. 5,067,924

Inventor: Beverly L. Munter

Issued: Nov. 26, 1991

The disclosure describes an apparatus and method for facilitating weight loss. In particular, a doll that will simulate weight loss and weight gain according to simultaneous weight loss and weight gain of the doll's owner is disclosed. Layers of "skin" made of stretchable synthetic material, such as vinyl, are added or removed from the doll each time the doll's owner gains or loses one weight increment, respectively. Each layer represents a particular predetermined weight increment, which may be determined by the doll's owner. The doll may be male or female, preferably includes jointed body parts, and may be dressed, such as in a running suit which fits over the layers of skin.

U.S. Pat. No. 5,125,865

Inventor: Henry Orenstein et al.

Issued: Jun. 30, 1992

A toy doll includes a doll body and an animating mechanism in the doll body. The doll body includes a head portion including a resiliently flexible mouth section, a longitudinally expandable and contractible torso portion, and right and left arms and legs. The animating mechanism is operative by manually depressing the mouth section to actuate the animating mechanism to reciprocally move the mouth section inwardly and outwardly to simulate a chewing activity, and it is thereafter operative by manipulating one of the arms to actuate the animating mechanism to longitudinally expand the torso portion to simulate a growing activity.

U.S. Pat. No. 5,415,580

Inventor: Jaime Ferri

Issued: May 16, 1995

A variable height double-faced doll, adaptable to the body and height of the user. The doll is made up of a body like those of ragdolls, with its corresponding limbs, lower and upper, being soft, as well as the head. Both the lower and upper limbs are made of elastics concertinered at the seams on the arms and legs to make stretching possible for their adaptation to the height and contours of the user. The bead has two faces, one on each side, which consist of hair and of a cap which are placed in such a way that they will complement each other in a different way on each respective face, depending which side is viewed. The widened parts that form the feet are endowed with a lower covering with two distinct parts on either side of a lower transverse fixing strap, so that each part of the covering is separable from the foot in order to form an opening for the positioning of the user's foot.

While these expandable dolls may be suitable for the purposes for which they were designed, they would not be as suitable for the purposes of the present invention as hereinafter described.

SUMMARY OF THE PRESENT INVENTION

The present invention discloses an expandable doll or other animal having a central, manually operated air pump which takes air in through a one-way valve located in the doll's naval and is then distributed proportionally to all the extremities through a semi-rigid, plastic tube air distribution system. The expansion takes place through the action of a system of bellows that connect each of the separate bodily elements at their normal junctures, i.e., elbow, knee, etc. The doll is covered with a realistic, elastic skin which complies with the stretching action of the bellows at each expanding juncture. Each bellows is custom designed for a particular body element in order to be able to expand to the extent and at a rate appropriate for that particular element at each incremental stage of development from a baby to a toddler, The present invention is also adaptable to other type animals.

A primary object of the present invention is to provide an expandable doll that will simulate the development of a child from an infant stage to a toddler stage.

Another object of the present invention is to provide an expandable doll that will simulate the development of a child from an infant stage to a toddler stage that is actuated, by simple, quick, singular, low-effort, manual input in small incremental movements such as pumping.

Another object of the present invention is to provide an expandable doll that will simulate the development of a child from an infant stage to a toddler stage that grows uniformly and incrementally in all areas of the body simultaneously.

Yet another object of the present invention is to provide an expandable doll that will simulate the development of a child from an infant stage to a toddler stage that gives the resulting configuration a more normal appearance.

Still yet another object of the present invention is to provide an expandable doll that will simulate the development of a child from an infant stage to a toddler stage that has stretchable natural looking skin.

Yet another object of the present invention is to provide an expandable doll that will simulate the development of a child from an infant stage to a toddler stage that grows uniformly and incrementally in all areas of the body wherein a single input results in an integrated proportional change to the entire doll.

Additional objects of the present invention will appear as the description proceeds.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
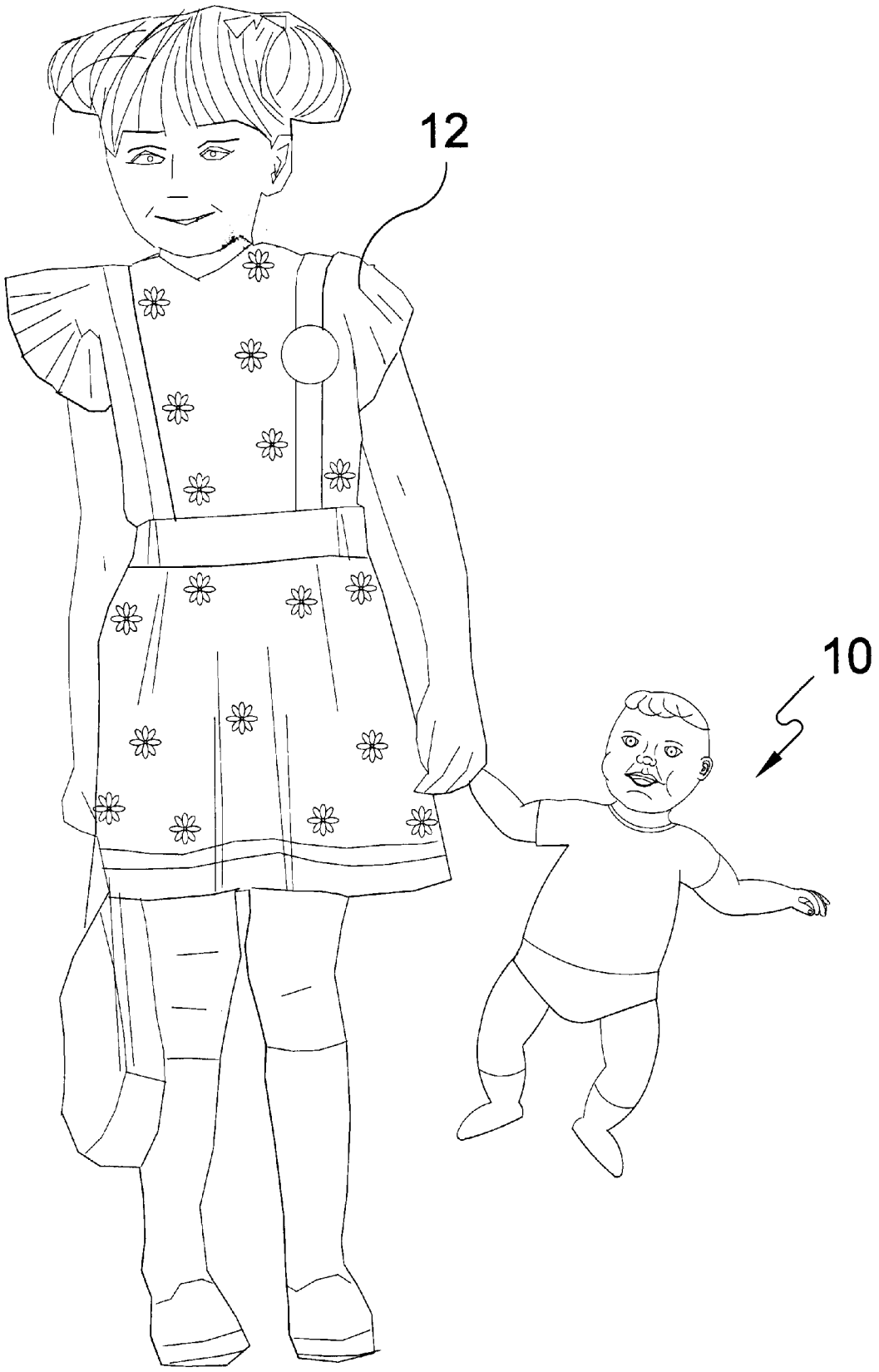
FIG. 1 is a view of a child holding the present invention, the Expandable Doll.

With regard to reference numerals used, the following numbering is used throughout the drawings.

10 present invention
12 user
14 air valve
16 arm joints
18 leg joints
20 head
22 hand pump
24 air duct
26 bellows
28 direction arrow
30 hand
32 expandable skin
34 central head duct
36 head air sac

DESCRIPTION OF THE PREFERRED EMBODIMENT(S)

In order that the invention may be more fully understood, it will now be described, by way of example, with reference to the accompanying drawings in which FIGS. 1 through 10 illustrate the present invention being an expandable doll or other animal.

Turning to FIG. 1, shown therein is a view of a child user 12 holding the present invention 10 which is an expandable doll.

Figure 2:
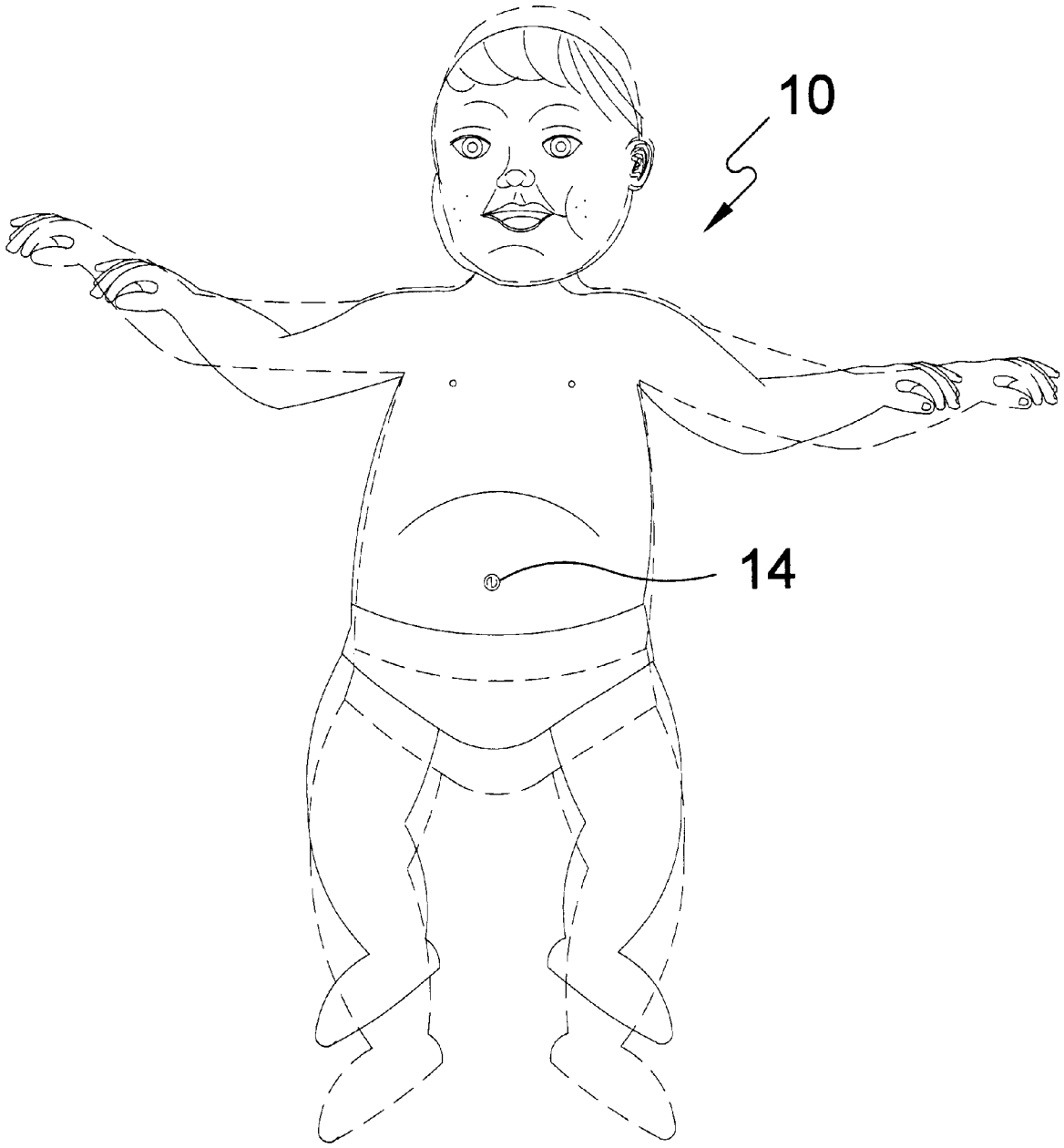
FIG. 2 is a view of the present invention, the Expandable Doll, indicating its ability to change its developmental configuration from infant to toddler by simply actuating the abdominal pump.

Turning to FIG. 2, shown therein is a view of the present invention 10, an expandable doll, indicating its ability to change its developmental configuration from infant to toddler by simply actuating the abdominal pump (not shown) with a one-way inlet air valve 14 in the approximate position of the naval of the doll.

Figure 3:
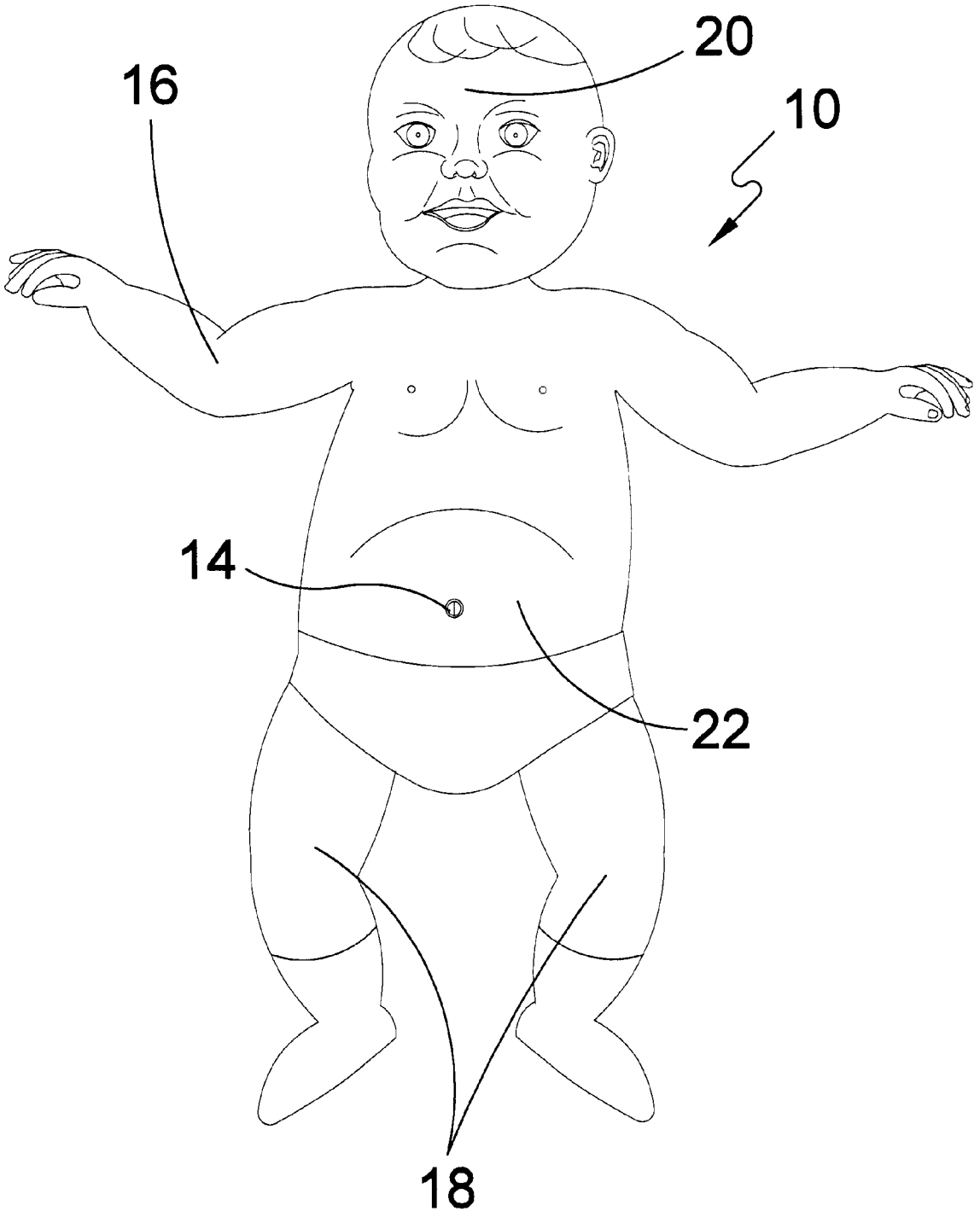
FIG. 3 is a view of the present invention, the Expandable Doll, indicating the ability of each body element to change its developmental configuration from infant to toddler through expandable joints and other appropriate growth areas by actuating the abdominal pump.

Turning to FIG. 3, shown therein is a view of the present invention 10, an expandable doll, indicating the ability of each body element to change its developmental configuration from infant to toddler through expandable joints being arm or elbow joints 16, leg or knee joints 18 and head 20 and other appropriate growth areas by actuating the abdominal hand 22 pump (not visible) with air valve 14.

Figure 4:
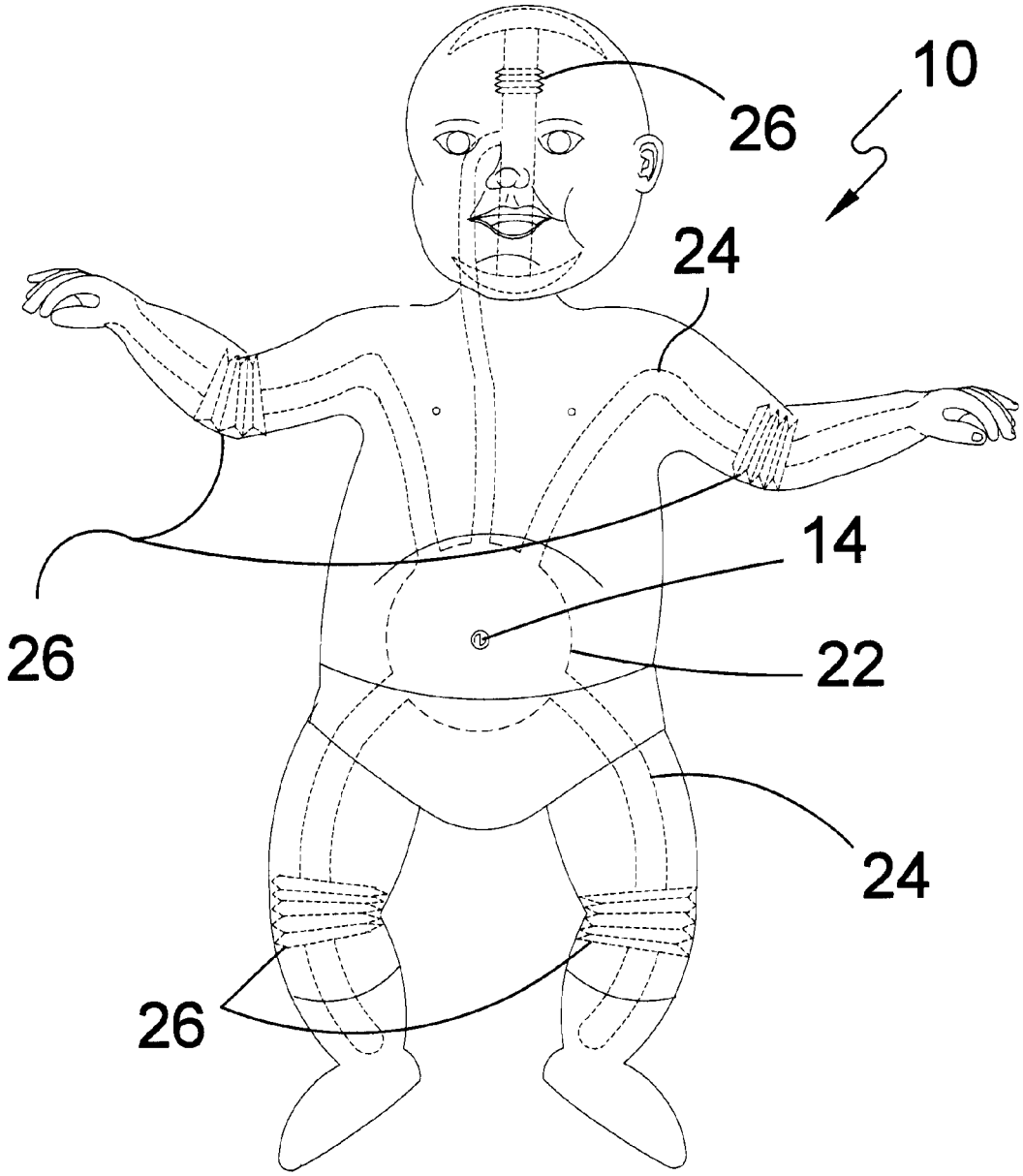
FIG. 4 is a view of the present invention, the Expandable Doll, showing the external and internal elements of the pneumatic pump and air distribution and expansion system connecting all the body elements.

Turning to FIG. 4, shown therein is a view of the present invention 10, showing the external and internal elements of the pneumatic hand pump 22 with air valve 14 and air distribution system being internal tubes or ducts 24 and expansion system being an air bellows 26 connecting all the body elements being arms, legs and head.

Figure 5:
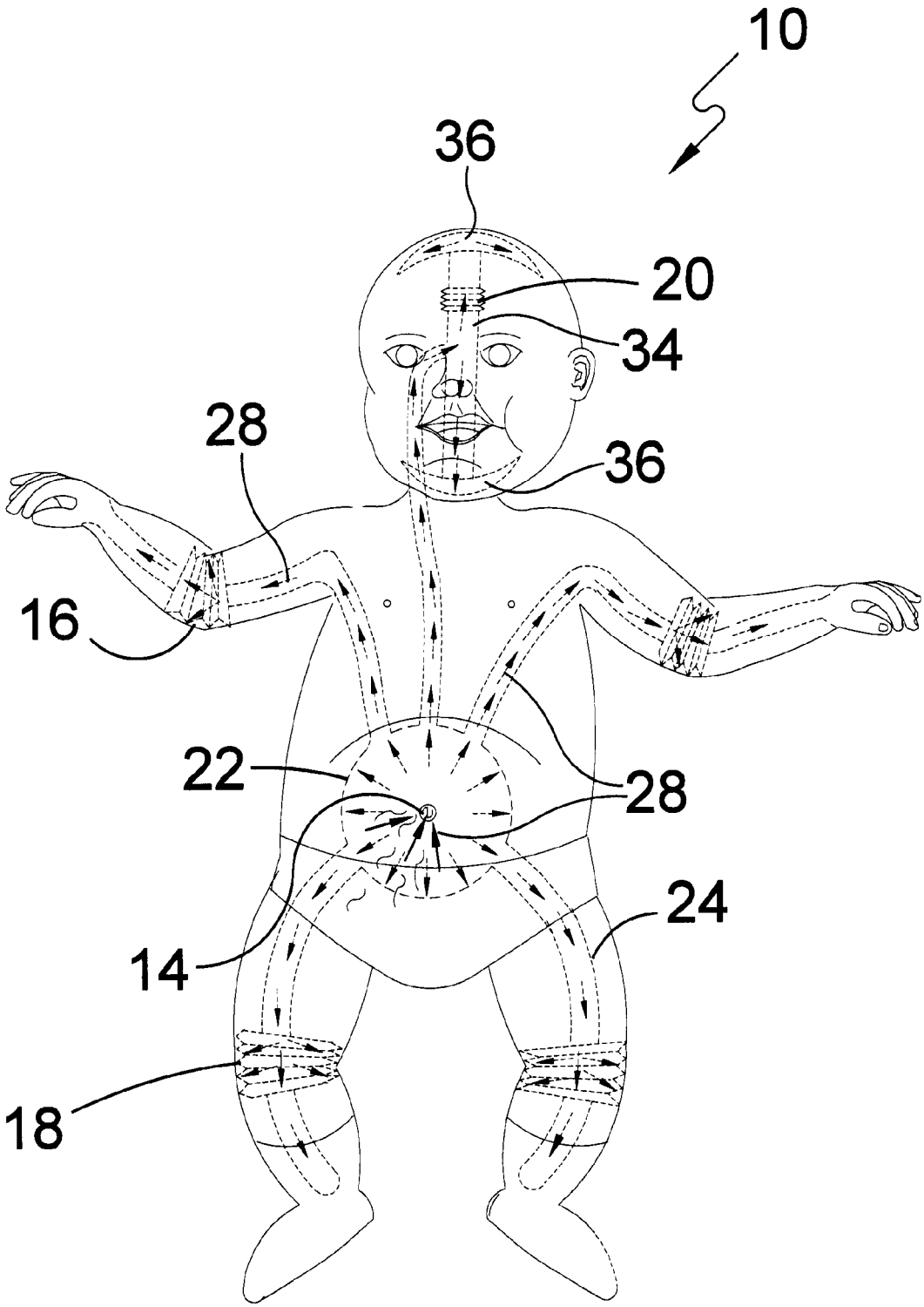
FIG. 5 is a view of the present invention, the Expandable Doll, showing the external and internal elements of the pneumatic pump and air distribution and expansion system in operation expanding the body at each of the bodily junctures as well as in the head area.

Turning to FIG. 5, shown therein is a view of the present invention 10, showing the external and internal elements of the pneumatic pump 22 and air distribution and expansion system in operation shown by direction arrows 28 expanding the body at each of the bodily junctures as well as in the head area. Air ducts 24 lead from the interior cavity of pump 22 to and centrally through each appendage, i.e., arm, leg, neck and head. In the head 20 a large central duct 34 is disposed generally parallel to the longitudinally oriented spinal cord area of the doll body which terminates in an expanded air sac 36 on each upper or head dome area and lower end or chin area having the head bellows and air duct connections disposed intermediately. Elements previously disclosed are also shown.

Figure 6:
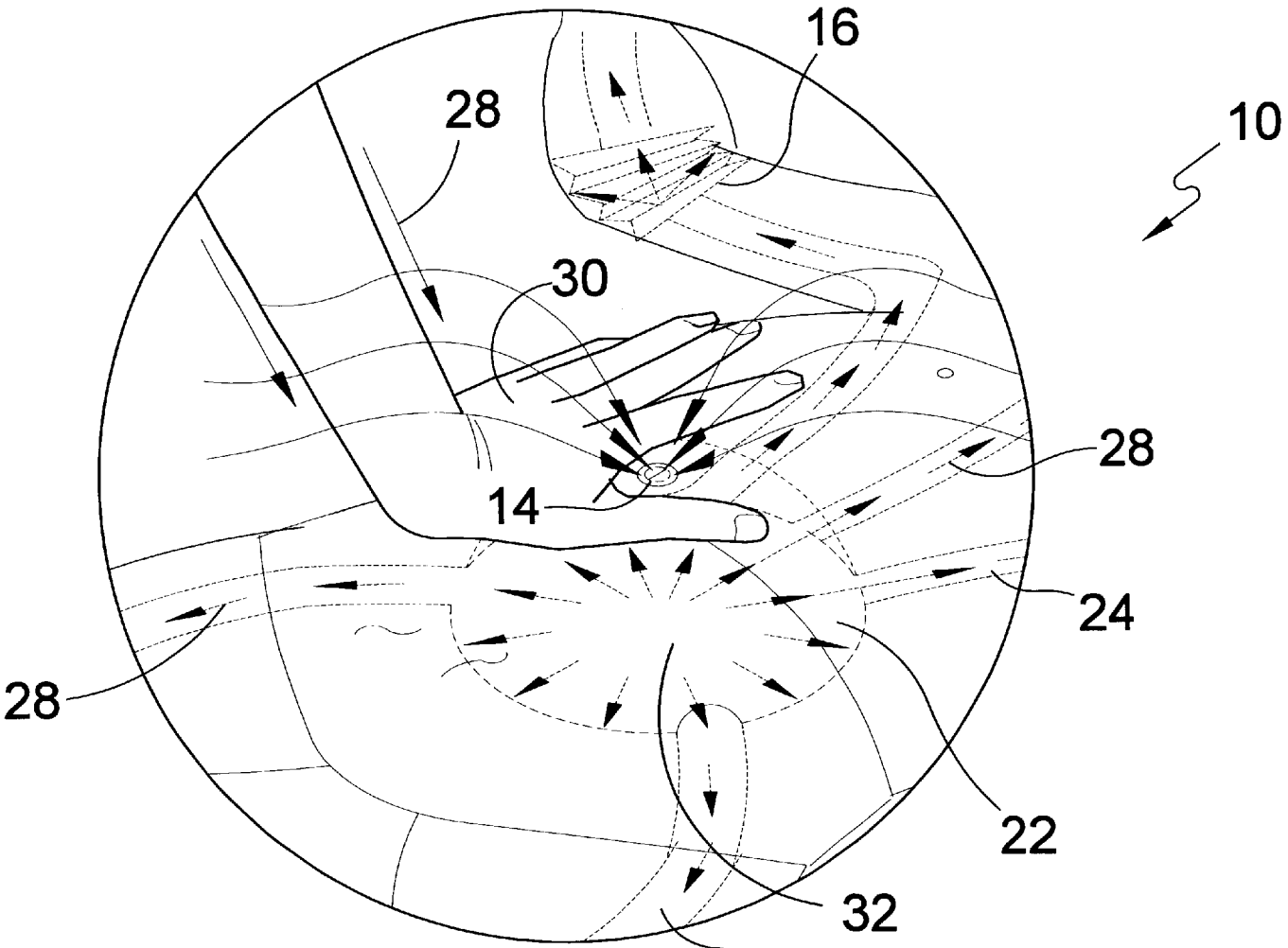
FIG. 6 is a detail view of the present invention, the Expandable Doll, showing a hand operating the pneumatic abdominal pump and the air distribution and expansion system in operation.

Turning to FIG. 6, shown therein is a detail view of the present invention 10, showing a hand 30 operating the pneumatic abdominal pump 22 and the air distribution and expansion system in operation as shown by arrows 28. Also shown are the stomach 32 of the doll, air ducts 24, air valve 14 and elbow bellows 16.

Figure 7:
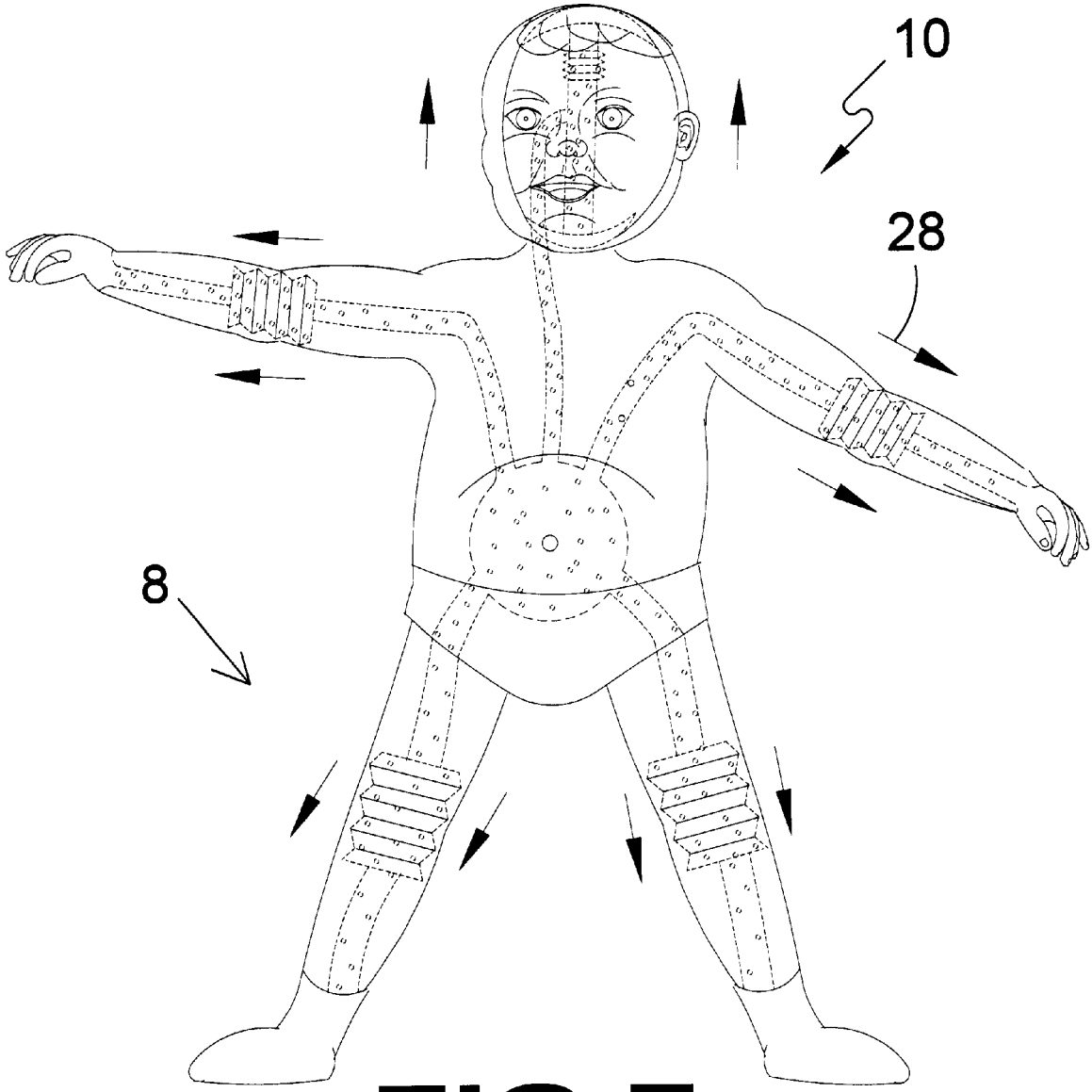
FIG. 7 is a view of the present invention, the Expandable Doll, showing a the doll fully inflated in the toddler stage.

Turning to FIG. 7, shown therein is a view of the present invention 10, showing a the doll fully inflated by arrows 28 in the toddler stage wherein the arms, legs and head are larger and extended.

Figure 8:
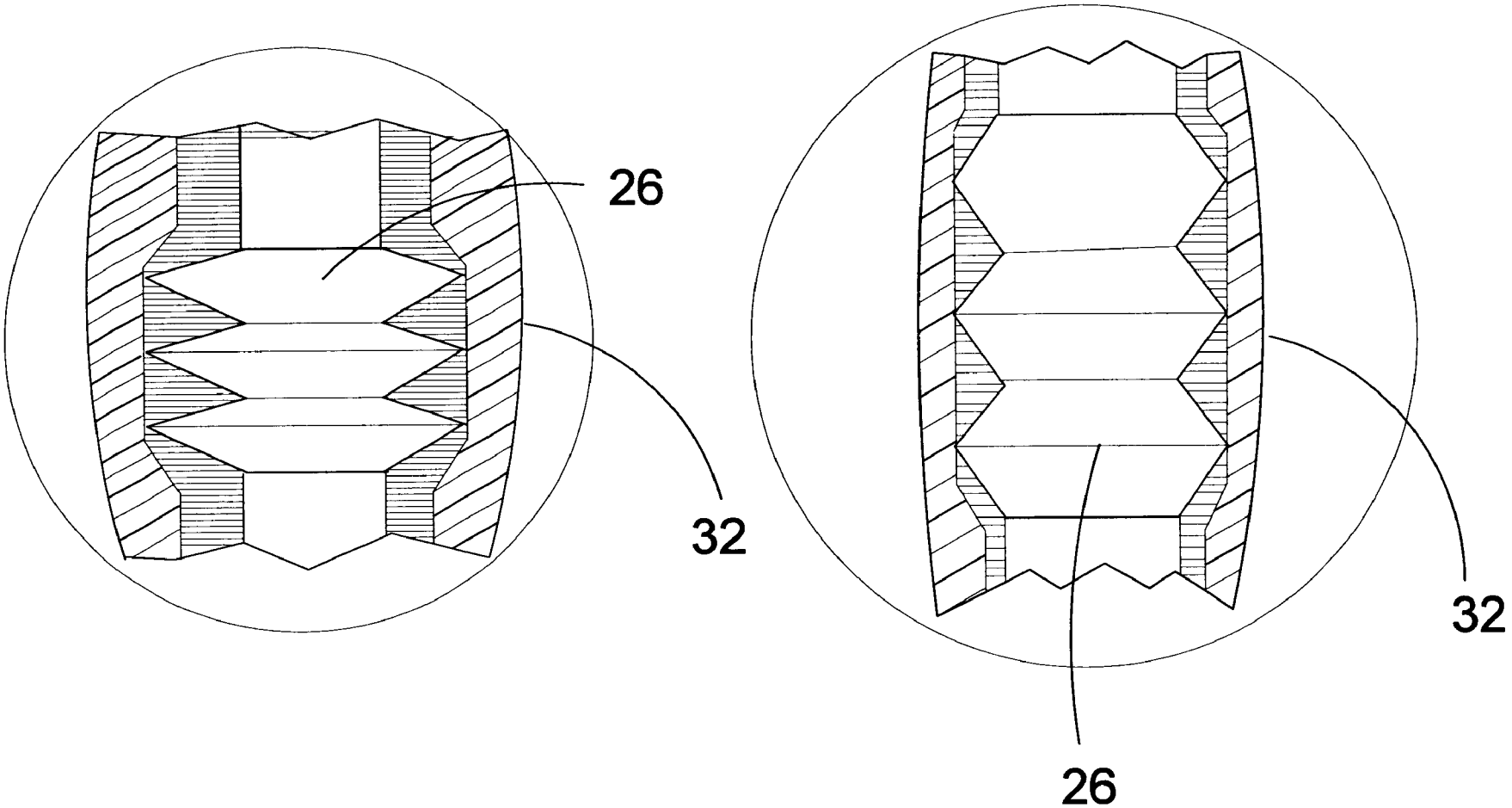
FIG. 8 is a section view of the expandable bellows within the flexible skin cover of the present invention, the Expandable Doll, showing the bellows in both expanded and unexpanded condition.

Turning to FIG. 8, shown therein is a section view of the expandable bellows 26 within the flexible skin cover 32 of the present invention 10, showing the bellows in both expanded and unexpanded condition.

Figure 9:
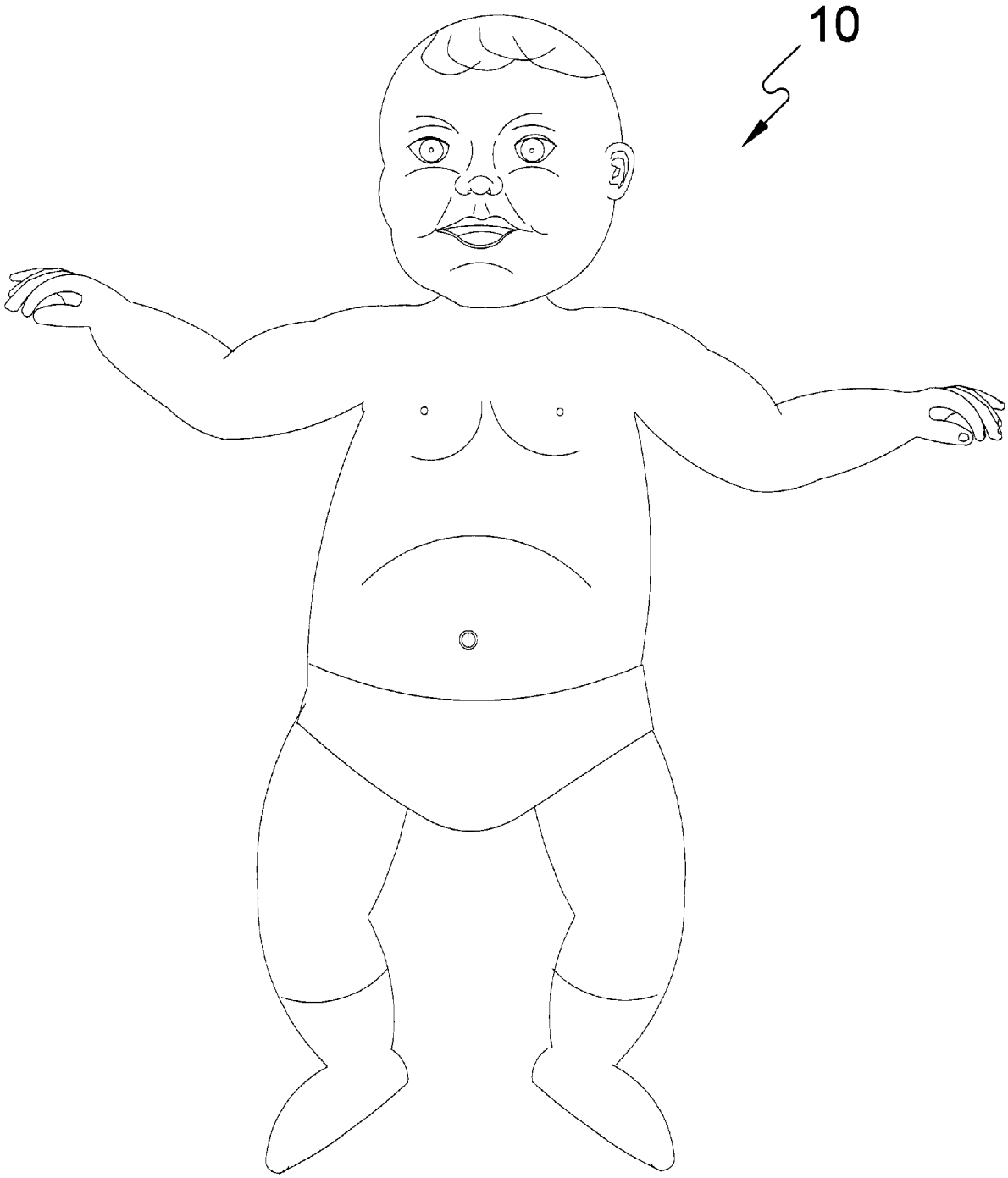
FIG. 9 is an exterior view of the present invention, the Expandable Doll, showing the doll uninflated in the infant stage.

Turning to FIG. 9, shown therein is an exterior view of the present invention 10, showing the doll uninflated in the infant stage.

Figure 10:
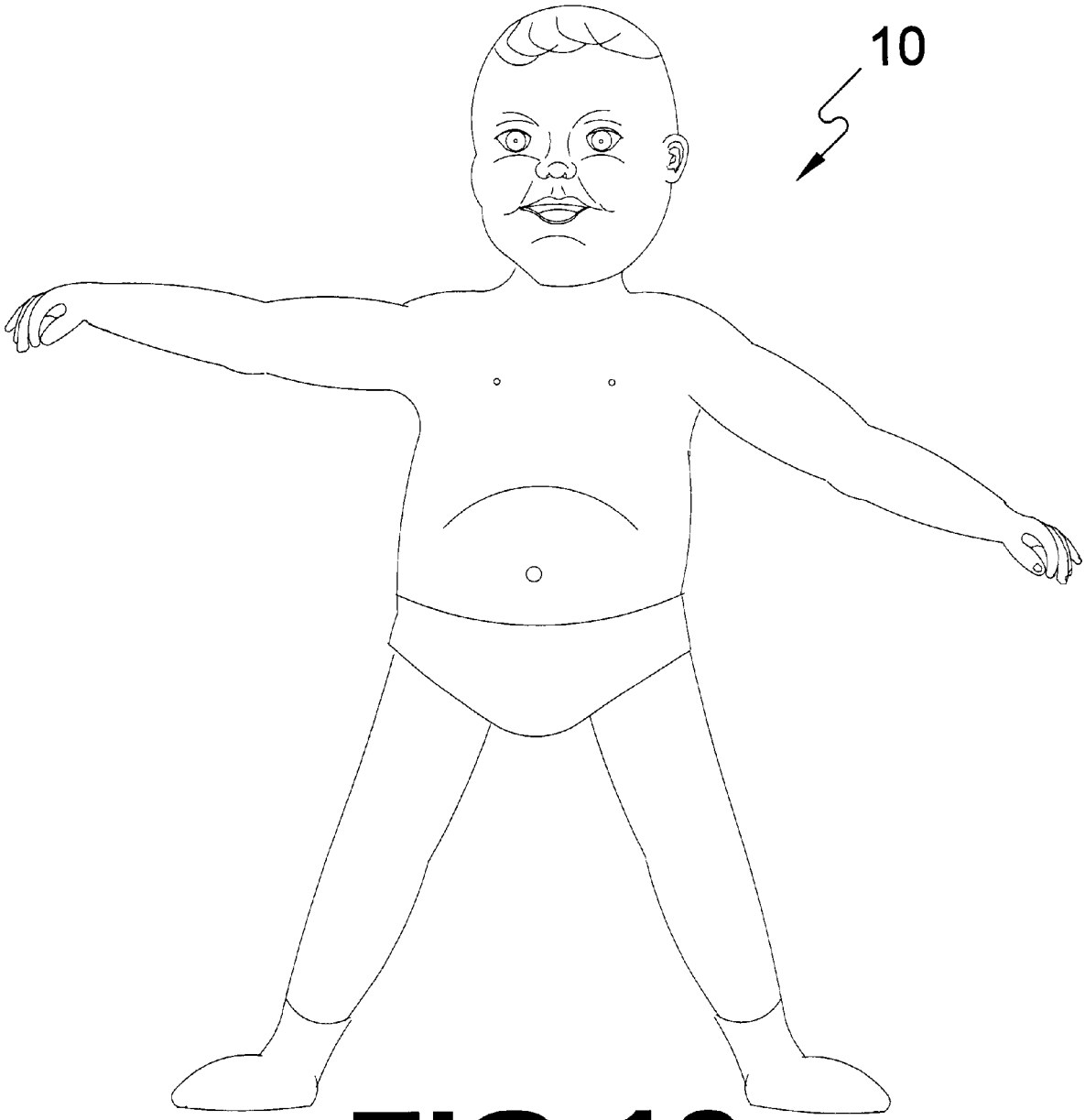
FIG. 10 is an exterior view of the present invention, the Expandable Doll, showing the doll fully inflated in the toddler stage.

Turning to FIG. 10, shown therein is an exterior view of the present invention 10, showing the doll fully inflated in the toddler stage.

It should be clear that the present invention can be adapted to and applied to many other types of small-scale representations or models of animals other than humans, e.g., dogs, horses, rabbits, monkeys, etc. Some of these other types of animals may not, e.g, have an elbow in the sense of a human, but may have comparable body junctions which serve to join various body appendages or limbs at an intermediate point. The present invention could be used in the other animals in a manner similar to that previously described for dolls in FIGS. 1 to 10.

I claim:

1. An expandable doll wherein the doll is made in the likeness of a human having two arms, two elbows, two hands, two legs, two knees, two feet, a navel, a head, a neck and an abdomen, the improvement comprising:

a) an air pump disposed in the abdomen area of the doll;

b) an inlet air valve for supplying air to said air pump;

c) a plurality of flexible air ducts extending from said air pump internally through the arms of the doll and terminating in the hands of the doll, further from said air pump through the legs of the doll and terminating in the feet of the doll, and from said air pump through the neck and head of the doll terminating in the head of the doll; and, d) a plurality of air bellows, one air bellows being disposed at each elbow of the doll, at each knee of the doll, and in the head of the doll.

2. The apparatus of claim 1, further comprising artificial elastic skin covering the doll.

3. The apparatus of claim 1, wherein said means for an air pump further comprises a hand-operated air pump.

4. The apparatus of claim 1, wherein said means for an air pump further comprises a pneumatic air pump.

5. The apparatus of claim 1, wherein said inlet air valve is disposed in the navel area of the doll.

6. The apparatus of claim 1, wherein said inlet air valve is a one-way air valve.

7. The apparatus of claim 1, wherein said inlet air valve is disposed in said air pump.

8. The apparatus of claim 1, wherein said plurality of air ducts are substantially centrally disposed in said arms and said legs of the doll.

9. The apparatus of claim 1, wherein said air bellows in said elbows of the doll are substantially the same diameter as said elbows of the doll.

10. The apparatus of claim 1, wherein said air bellows in said knees of the doll are substantially the same diameter as said knees of the doll.

11. The apparatus of claim 1, wherein said air duct disposed in the head of the doll further comprises a centrally disposed duct member, said central member being substantially parallel with the longitudinal axis of the doll.

12. The apparatus of claim 11, wherein said central duct member has a lower end and an upper end, said upper end terminating in an air sac disposed adjacent to the upper portion of the head of the doll.

13. The apparatus of claim 12, wherein said upper end of said central duct member is complementarily shaped as the upper portion of the head of the doll.

14. The apparatus of claim 13, wherein said lower end of said central duct member is disposed adjacent to the lower portion of the head of the doll.

15. The apparatus of claim 13, wherein said lower end of said central duct member is complementarily shaped as the lower portion of the head of the doll.

16. The apparatus of claim 15, wherein said air bellows is disposed intermediately in said central duct member.

17. An expandable small-scale representation of an animal wherein the animal has multiple appendages, a head, a neck and an abdomen, the improvement comprising:

a) an air pump disposed in the abdomen area of the animal;

b) an inlet air valve for supplying air to said air pump;

c) a plurality of flexible air ducts extending from said air pump: internally through the appendages of the animal terminating in the distal ends of said appendages of the animal, and from said air pump through the neck and head of the animal terminating in the head of the animal;

d) a plurality of air bellows, one air bellows being disposed substantially intermediately in each appendage of the animal and one air bellows being disposed in the head of the animal; and, e) means for artificial elastic skin covering the animal.

18. The apparatus of claim 17, wherein said air duct disposed in the head of the animal further comprises a centrally disposed duct member, said central member being substantially parallel with the longitudinal axis of the animal.

19. The apparatus of claim 18, wherein said central duct member has a first end and a second end, said first end terminating in an air sac disposed adjacent to the upper portion of the head of the animal.

20. The apparatus of claim 19, wherein said first end of said central duct member is complementarily shaped as the upper portion of the head of the animal.

21. The apparatus of claim 20, wherein said second end of said central duct member is disposed adjacent to the lower portion of the head of the animal.

22. The apparatus of claim 21, wherein said second end of said central duct member is complementarily shaped as the lower portion of the head of the animal.

23. The apparatus of claim 22, wherein said air bellows is disposed intermediately in said central duct member.

* * * * *